US008776411B2

(12) United States Patent
Ducruet et al.

(10) Patent No.: US 8,776,411 B2
(45) Date of Patent: Jul. 15, 2014

(54) IRONING BOARD COMPRISING TWO LEGS ARRANGED IN AN X-CONFIGURATION

(71) Applicant: SEB S.A., Ecully (FR)

(72) Inventors: Guy Ducruet, Lyons (FR); Daniel Vieira Gameiro, Leira (PT)

(73) Assignee: Tefal, Ecully (FR)

( * ) Notice: Subject to any disclaimer, the term of this patent is extended or adjusted under 35 U.S.C. 154(b) by 0 days.

(21) Appl. No.: 13/900,957

(22) Filed: May 23, 2013

(65) Prior Publication Data

US 2013/0312297 A1 Nov. 28, 2013

(30) Foreign Application Priority Data

May 24, 2012 (FR) ..... 12 54788

(51) Int. Cl.
*D06F 81/04* (2006.01)
*A47B 3/02* (2006.01)

(52) U.S. Cl.
USPC ..... 38/137; 108/120

(58) Field of Classification Search
USPC ..... 108/117–119, 120; 38/103–139
See application file for complete search history.

(56) References Cited

U.S. PATENT DOCUMENTS

| | | | | | |
|---|---|---|---|---|---|
| 858,969 | A * | 7/1907 | French | 108/168 |
| 1,115,731 | A * | 11/1914 | Owens | 108/35 |
| 2,738,604 | A * | 3/1956 | Toth | 108/36 |
| 2,908,984 | A * | 10/1959 | Lantz | 108/117 |
| 3,288,090 | A * | 11/1966 | King | 108/138 |
| 7,685,750 | B2 * | 3/2010 | Voitchovsky | 38/103 |
| 8,359,774 | B2 * | 1/2013 | Trowsdale et al. | 38/137 |

FOREIGN PATENT DOCUMENTS

| | | | |
|---|---|---|---|
| CH | 198108 | A | 6/1938 |
| EP | 1536055 | A1 | 6/2005 |
| GB | 449441 | A | 6/1936 |
| GB | 729630 | A | 5/1955 |
| GB | 804645 | A | 11/1958 |

* cited by examiner

*Primary Examiner* — Ismael Izaguirre
(74) *Attorney, Agent, or Firm* — The Webb Law Firm

(57) ABSTRACT

Ironing board comprising a frame supporting a top and at least two legs joined to the frame, one of the legs having an upper end pivotably mounted on a back end of the frame, the other leg having an upper end slidably mounted on said frame, the two legs being connected to one another by a pivot linkage and movable between a storage position, and a working position.

14 Claims, 6 Drawing Sheets

IRONING BOARD COMPRISING TWO LEGS ARRANGED IN AN X-CONFIGURATION

BACKGROUND OF THE INVENTION

1. Field of the Invention

The present invention relates to an ironing board having a top resting on a frame supported by at least two legs arranged in the shape of an X, the two legs being connected to one another by a pivot linkage at a midpoint of their length, and more particularly relates to an ironing board in which one of the legs is divided into two parts joined to one another by a joint allowing, when the legs are aligned lengthwise with the top, the pivoting of a lower segment of the leg from an unfolded position, in which the lower segment is disposed in the extension of an upper segment of the first leg, to a folded position in which the lower segment is folded over the upper segment.

2. Prior Art

European Patent no. 1 536 055 discloses an ironing board having a top resting on a frame supported by two legs arranged in the shape of an X, the two legs being connected to one another by a pivot linkage at a midpoint of their length, the two legs being in two parts and comprising a joint permitting the pivoting of a lower segment from an unfolded position, in which the lower segment is arranged in the extension of an upper segment of the first leg, to a folded position, in which the lower segment is folded over the upper segment.

Such an ironing board has the advantage of being highly compact.

However, such an ironing board has the disadvantage of not being ergonomic to use, in particular because the user must turn the ironing board over with the top resting flat on the floor in order to be able to fold or unfold the two legs. Such a maneuver is extremely inconvenient and may require considerable muscular effort that is beyond the ability of weaker individuals.

Hence an object of the present invention is to remedy these disadvantages by proposing a compact ironing board with good ergonomics and which is easily and cost-effectively implemented. Another object of the present invention is to propose an ironing board with high stability for greater operational safety.

To this end, the subject of the invention is an ironing board comprising a frame supporting a top and at least two legs joined to the frame, one of the legs having an upper end pivotably mounted on a back end of the frame, the other leg having an upper end slidably mounted on the frame, wherein the two legs are connected to one another by a pivot linkage at a midpoint of their length and are movable between a storage position, in which the legs are arranged essentially parallel to the top, and a working position, in which the legs are arranged in the shape of an X, wherein one of the legs, the so-called first leg, is divided into two parts joined to one another by a joint allowing, when the legs are in the storage position, the pivoting of a lower segment of the first leg from an unfolded position, in which the lower segment is disposed in the extension of an upper segment of the first leg, to a folded position, in which the lower segment is folded over the upper segment, characterized in that the other leg, the so-called second leg, is in one piece and in that the lower end of the second leg reaches the back end of the frame when the first and second legs are in the storage position.

The advantage of such a characteristic resides in the fact that it is thus possible to obtain a compact ironing board that is easily folded and unfolded, wherein the ironing board can be stood more or less upright on its second leg in order to fold or unfold the upper segment of the first leg when the legs are in the storage position.

The folding and unfolding of the ironing board is thus achieved by a simple maneuver, in which the second leg remains resting on the floor so that the user does not have to support the weight of the ironing board.

According to another characteristic of the invention, the joint has means for securing the lower segment in the unfolded position.

According to another characteristic of the invention, the securing means comprise a device for locking the lower segment in the unfolded position and at least one unlocking button for deactivating the locking device.

According to another characteristic of the invention, the joint has two unlocking buttons disposed on two opposite surfaces of the joint.

According to another characteristic of the invention, the joint has a rotation axis which is offset to the periphery of the leg.

According to another characteristic of the invention, the first leg has an upper end pivotably mounted near an end of the frame.

According to another characteristic of the invention, the top has a back end that is situated on the side of the frame receiving the upper end of the first leg, wherein the top is wider in the vicinity of its back end than in the vicinity of its front end.

According to another characteristic of the invention, the top has a main part slidably mounted on the frame and at least one foldable part joined to the main part by hinges, wherein the foldable part is movable between a working position, in which it is disposed in the extension of the main part, and a storage position, in which it is folded over the main part.

According to still another characteristic of the invention, the foldable part is a back part of the top.

According to another characteristic of the invention, the frame supports an iron rest that is linearly movable on the frame between a working position, in which the iron rest is arranged next to the foldable back part of the top in the working position, and a storage position, in which the foldable back part and the main part of the top are at least partly disposed under or on the iron rest.

According to still another characteristic of the invention, the second leg comprises an upper end that is pivotably and slidably mounted on the frame.

According to still another characteristic of the invention, the upper end of the second leg is mounted so that it is linearly movable along a guide track borne by the frame.

According to still another characteristic of the invention, the first leg and the second leg each have a lower end equipped with a cross member extending transversely to the top, the cross members having essentially the same width as the overall width of the top.

According to still another characteristic of the invention, the cross member of the second leg has casters.

According to still another characteristic of the invention, the ironing board has a platform supported on a framework comprising a longitudinal end mounted pivotably about an axis borne by the upper segment of the first leg, between the pivot linkage and the joint.

According to still another characteristic of the invention, the length of the first leg is greater than the length of the frame.

BRIEF DESCRIPTION OF THE DRAWINGS

The objects, aspects, and advantages of the present invention will emerge more clearly from the following description of a special embodiment of the invention, which is presented as a non-limiting example and which refers to the appended drawings, in which.

DETAILED DESCRIPTION OF THE INVENTION

Only the elements necessary for understanding the invention are illustrated. To make the drawings easier to read, the same elements have the same reference signs in all figures.

Figure 1:
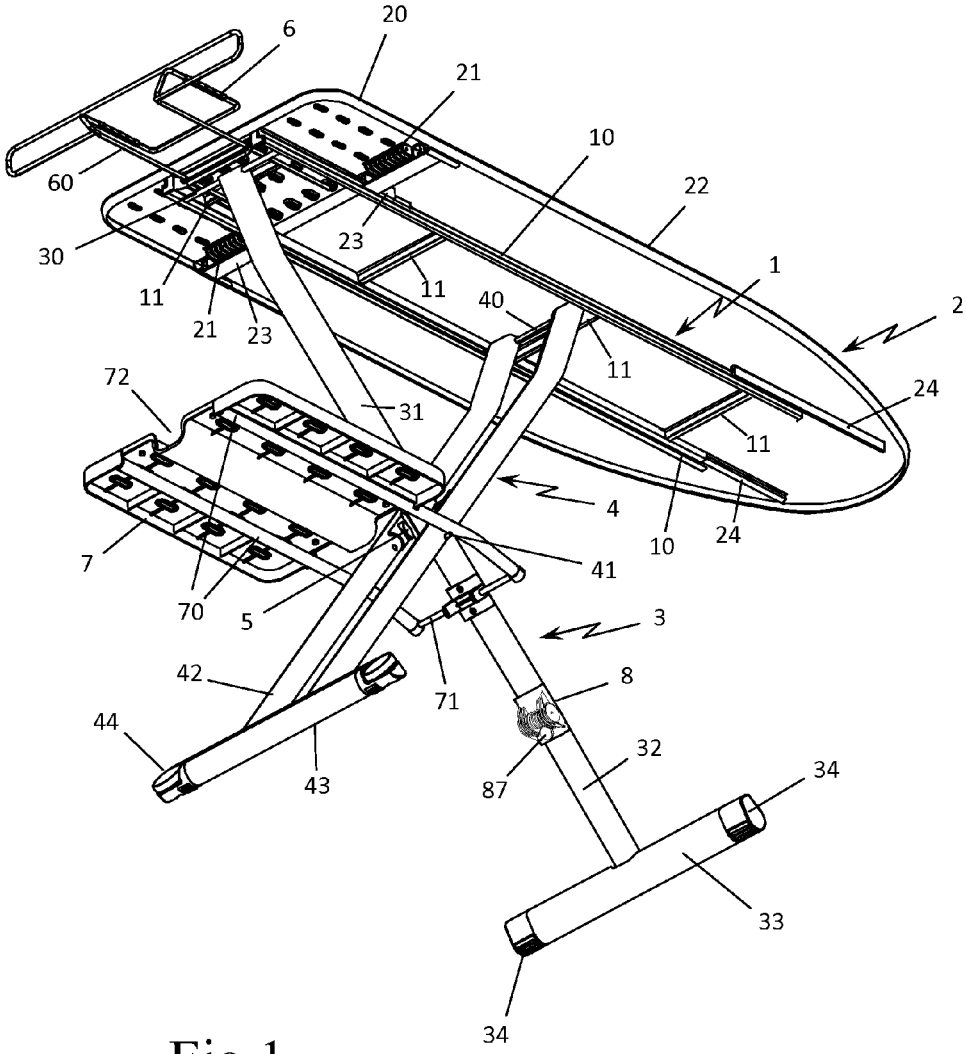
FIG. 1 is a perspective view from below of an iron board according to a special embodiment of the invention in which the ironing board is illustrated with the top and the iron rest in the working position.
Figure 2:
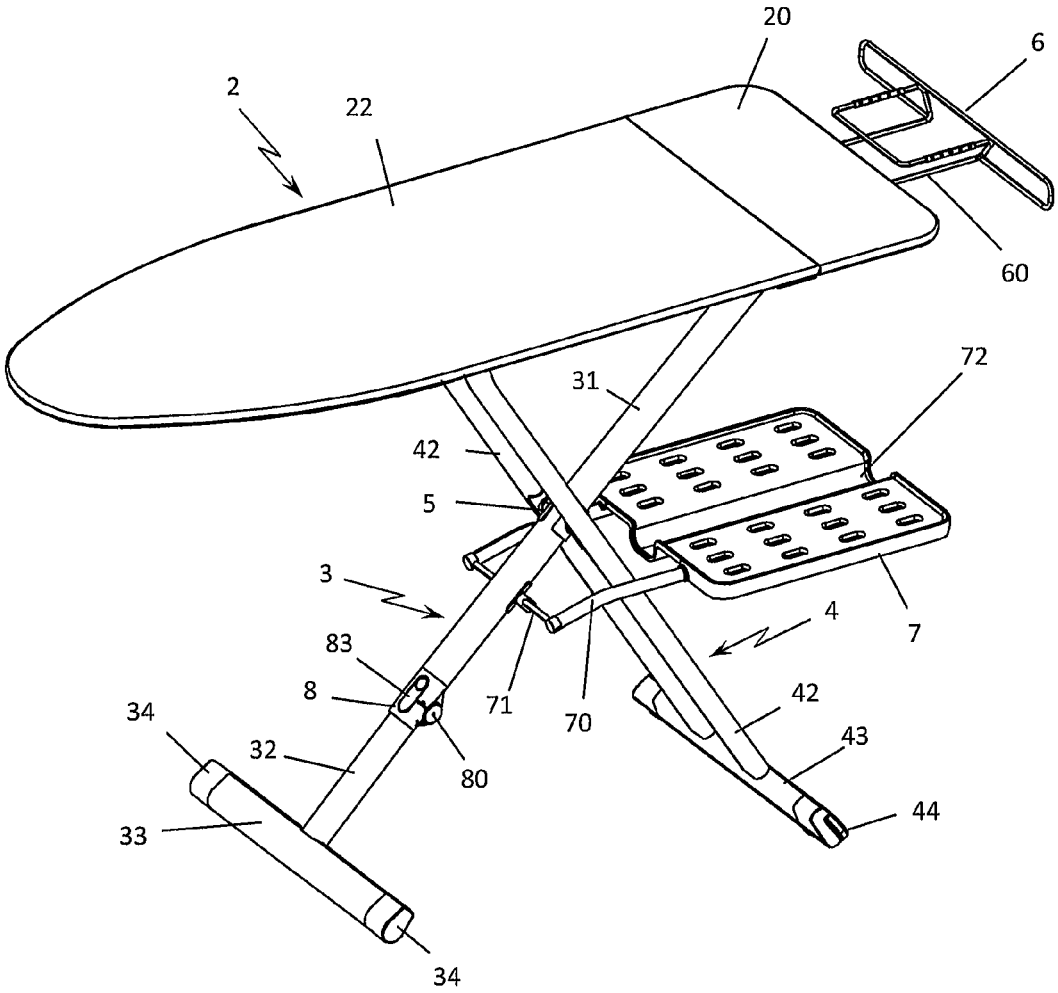
FIG. 2 is a perspective view from above of the ironing board illustrated in FIG. 1.

FIGS. 1 and 2 illustrate an ironing board having a frame 1 supporting a top 2, wherein the top decreases in width in the vicinity of its rounded front end and wherein the frame 1 is supported by two rigid legs 3, 4 arranged in the shape of an X and the two legs 3, 4 are connected to one another by a pivot linkage 5 located at a midpoint of their length.

The frame 1 has two side rails 10 advantageously made of extruded aluminum profiles around 100 cm in length and connected to each other by means of four cross members 11, one of the legs (the so-called first leg 3) having an upper end integrally formed with a shaft 30 pivotably mounted near a back end of the frame 1, the other leg (the so-called second leg 4) having an upper end integrally formed with a shaft 40 slidably mounted in the guide tracks arranged on an inside lateral surface of the side rails 10, wherein the longitudinal positioning of the shaft 40 along the side rails 10 and consequently the height of the top 2 of the ironing board can be adjusted in a manner known per se by means of a blocking device, which is not illustrated in the figures.

Figure 3:
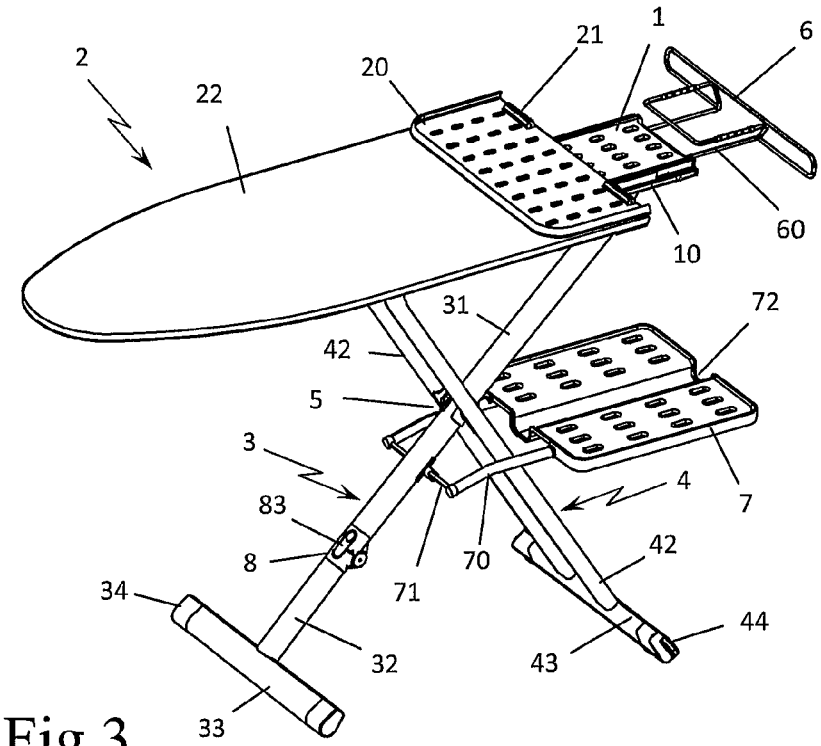
FIG. 3 is a perspective view similar to FIG. 1 illustrating the ironing board in a phase of folding the top for storage.
Figure 4:
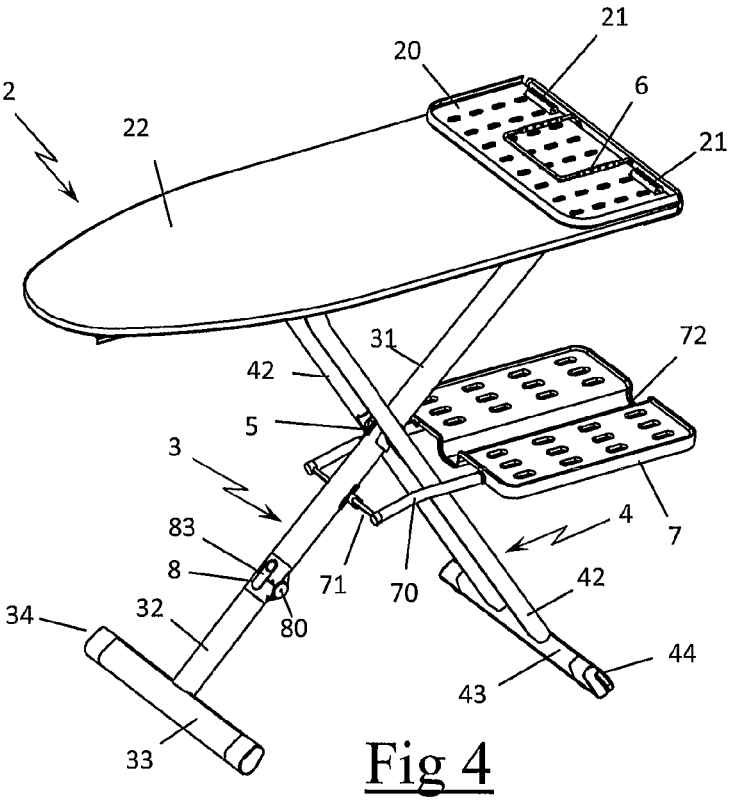
FIG. 4 is a perspective view similar to FIG. 1 illustrating the ironing board with the top and the iron rest in the storage position.
Figure 5:
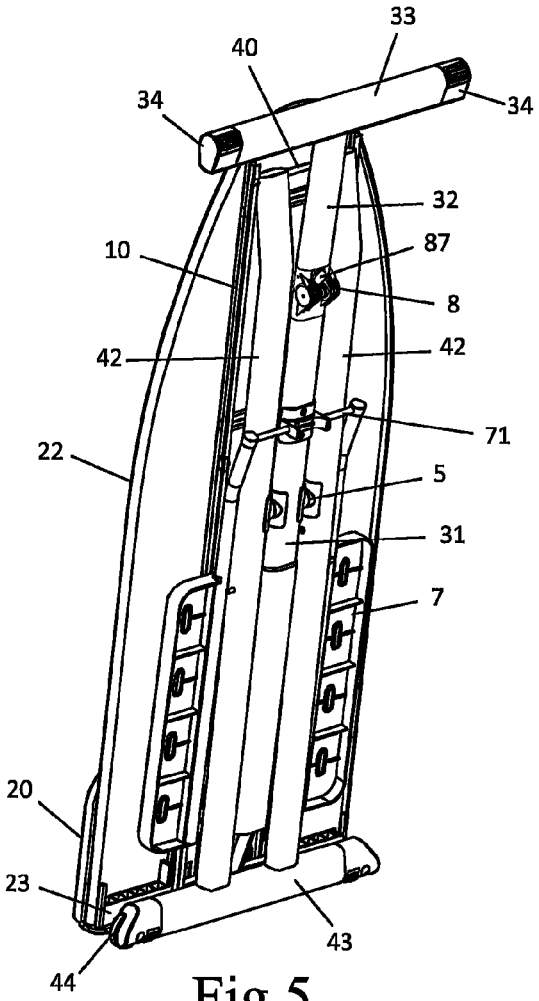
FIGS. 5 and 6 are perspective views of the ironing board with the top, the iron rest, and the legs in the storage position, wherein the lower segment of the first leg is shown in an unfolded position and in a folded position, respectively.
Figure 6:
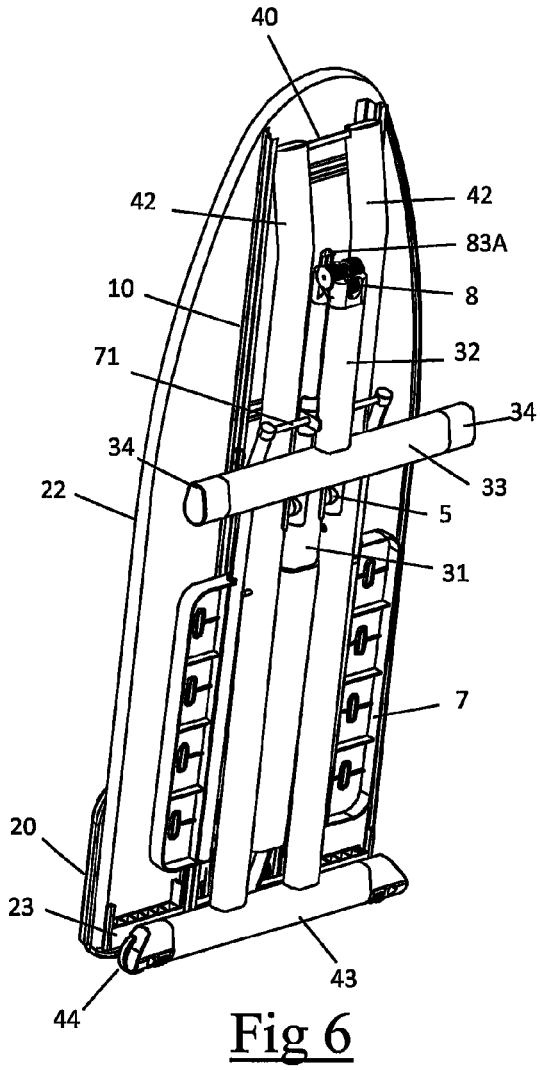

The legs 3, 4 thus connected to the frame can be moved between a working position illustrated in FIGS. 1-4, in which the legs 3, 4 are arranged in the shape of an X, and a storage position illustrated in FIGS. 5 and 6, in which the legs 3, 4 are arranged essentially parallel to the top 2.

According to FIG. 3, the top 2 preferably has a foldable back part 20 around 20 cm in length, which is connected by double pivot hinges 21 to a main part 22 extending over a length of around 110 cm, the top 2 having a width of around 45 cm over three fourths of its length from its back end.

The foldable back end 20 of the top thus configured can occupy a working position illustrated in FIGS. 1 and 2, in which the back part 20 rests on the side rails 10 and lies in the extension of the main part 22 of the top 2 in order to form a continuous ironing surface with the latter, the back part 20 also being capable of occupying a storage position in which it is folded over the main part 22 of the top 2, as illustrated in FIGS. 3 and 4.

As can be seen in FIG. 1, the main part 22 of the top 2 is fastened near its back end to a carriage 23 and near its front end to two longitudinal guide strips 24, the carriage 23 and the guide strips 24 being slidably mounted in the slides formed on the outer surface of the side rails 10 in such a way that the top 2 is linearly displaceable along the frame 1 between a working position illustrated in FIGS. 1 and 3, in which the back end of the main part 22 of the top 2 extends 20 cm beyond the back end of the frame 1, and a storage position illustrated in FIGS. 4-6, in which the back end of the main part 22 of the top 2 is even with the back end of the frame 1, the carriage 23 being equipped with a braking device (not illustrated in the figures) for securing the top 2 in the desired position.

Preference is given to the ironing board also having an iron rest 6 disposed in the extension of the top 2 and a platform 7 disposed under the top 2, which is designed for holding laundry or a steam generator.

The iron rest 6 is advantageously made of a folded metal wire and is supported by two arms 60 slidably mounted on the back end of the frame 1, the iron rest 6 being linearly movable between a working position illustrated in FIG. 2, in which the iron rest 6 is disposed cantilevered to the outside of the frame 1 and is situated next to the top 2, and a storage position illustrated in FIG. 4, in which the iron rest 6 is repositioned over the top 2 in the storage position and wherein the iron rest 6 is slightly raised relative to the top 2 in such a way that the back end of the main part 22 of the top 2 and the back part 20 arranged in the storage position can be inserted under the iron rest 6 in the manner shown in FIG. 4.

The platform 7 is advantageously made of plastic and is supported by a framework comprising two longitudinal tubes 70, the ends of which are joined together by a transverse tube 71 pivotably mounted on the first leg 3 slightly lower than the pivot linkage 5 joining the two legs 3, 4, the second leg 4 having rollers 41 on which the longitudinal tubes 70 come to rest for keeping the platform 7 in a horizontal position when the legs 3, 4 are deployed in the working position. When the legs 3, 4 are brought into the storage position, the platform 7 pivots about the tube 71 and aligns itself parallel to the top 2, wherein the platform 7 has a longitudinal trough 72 that forms a recess adapted for receiving the first leg 3, as illustrated in FIGS. 5 and 6.

The first leg 3 is in two parts and has an upper segment 31 and a lower segment 32 joined to one another by a joint 8 that allows the lower segment 32 to pivot between an unfolded position illustrated in FIG. 5, in which the lower segment 32 is arranged in alignment with the upper segment 31 of the leg, and a folded position illustrated in FIG. 6, in which the lower segment 32 is folded over and essentially parallel to the upper segment The upper segment 31 of the first leg 3 is advantageously made of a straight tube about 85 cm in length equipped with a slight elbow roughly ten centimeters from its top end, and the lower segment 32 is made of a straight tube about 20 cm in length, the lower end of the lower segment 32 having a cross member 33 around 45 cm in length equipped with an anti-skid shoe 34 on each of its ends.

The second leg 4 is in one piece and is advantageously composed of two essentially parallel straight tubes 42 around 105 cm in length, wherein the two tubes are joined at their top end to the shaft 40 slidably mounted on the frame 1 and are joined at their lower end to a cross member 43 around 45 cm in length having, on each of its ends, a caster 44 oriented lengthwise to said cross member 43.

According to FIGS. 7-12, the joint 8 connecting the upper segment 31 to the lower segment 32 of the first leg has a rotation axis 80 connecting a first part 81 of the joint, which fits into the tube of the upper segment 31, to a second part 82 of the joint, which fits into the tube of the lower segment 32, wherein the rotation axis 80 is aligned perpendicular to the first leg 3 and offset to the periphery of the first leg in such a way that the lower segment 32 can be rotated 180° and folded over the upper segment 31.

Figure 7:
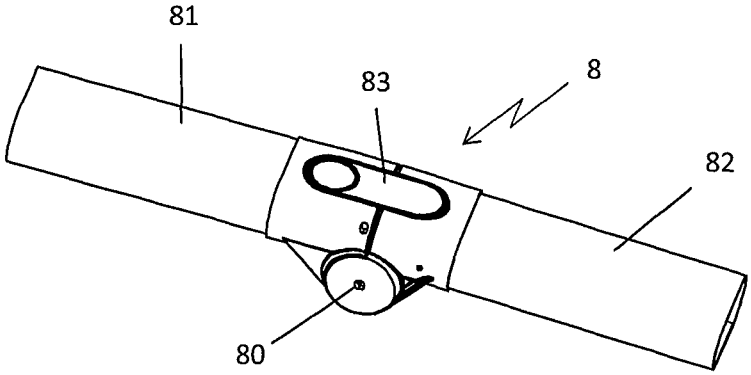
FIGS. 7 and 8 are detailed, perspective views of the joint of the first leg of the ironing board in the unfolded position.
Figure 8:
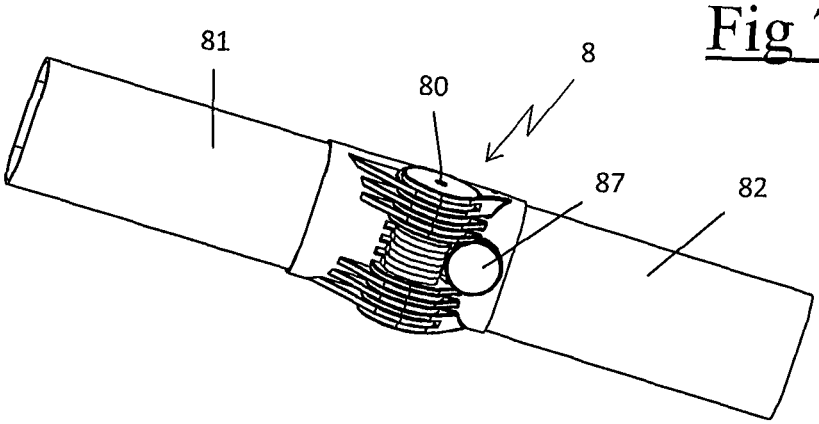

Preference is given to the joint 8 having means for securing the lower segment in the unfolded position consisting of a locking device comprising a first unlocking button 83 disposed on an upper surface of the leg, which can be discerned in FIG. 7, and a second unlocking button 87 disposed on a lower surface of the first leg 3, which can be discerned in FIG. 8.

Figure 10:
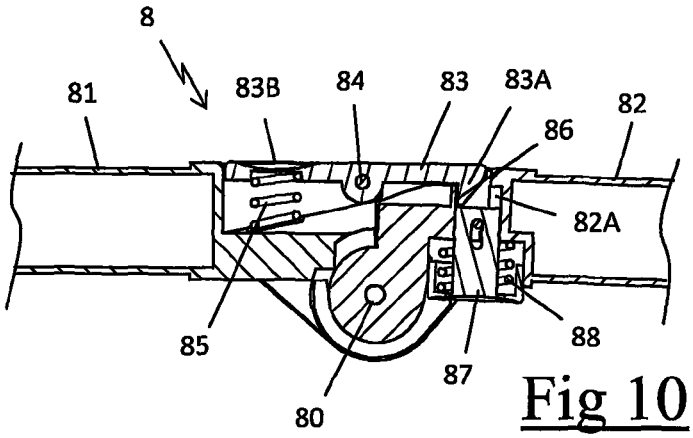
FIG. 10 is a cutaway view of the joint of FIG. 8 when neither unlocking button is actuated.
Figure 11:
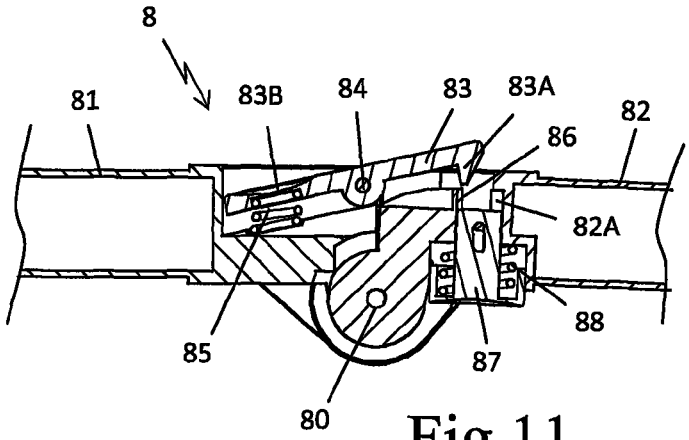
FIGS. 11 and 12 are cutaway views of the joint of FIG. 8 when the first unlocking button and the second unlocking button, respectively, are actuated.
Figure 12:
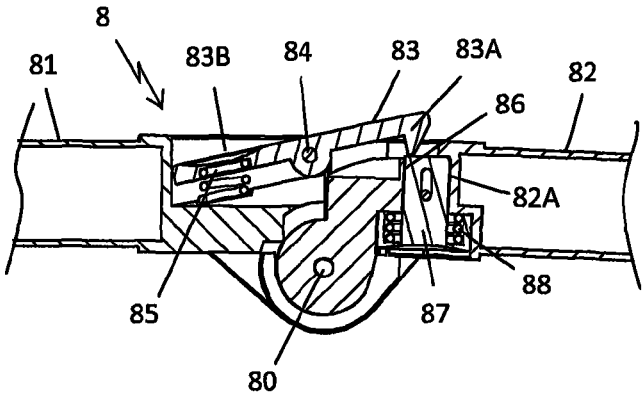

According to FIGS. 10-12, the first unlocking button 83 is mounted pivotably about an axis 84 borne by the first part 81 of the joint near the side of the joint 8 opposite the side receiving the rotation axis 80, wherein the first unlocking button 83 has an end equipped with a hook 83A and an opposite end equipped with an actuating zone 83B, which is formed by a recess on the surface of the first button 83, and wherein said first unlocking button 83 can be moved between a rest position illustrated in FIG. 10, to which it is restored by a return spring 85, and an actuated position, into which it is brought when the user presses on the actuation zone 83B, as shown in FIG. 11.

When the first unlocking button 83 is in the rest position, the hook 83A engages behind a block stop 86 borne by the second part 82 of the joint, as illustrated in FIG. 10. The block stop 86 extends in a plane perpendicular to the longitudinal axis of the second part 82 such that the engagement of the hook 83A behind the block stop 86 locks the joint 8 in the unfolded position.

Figure 9:
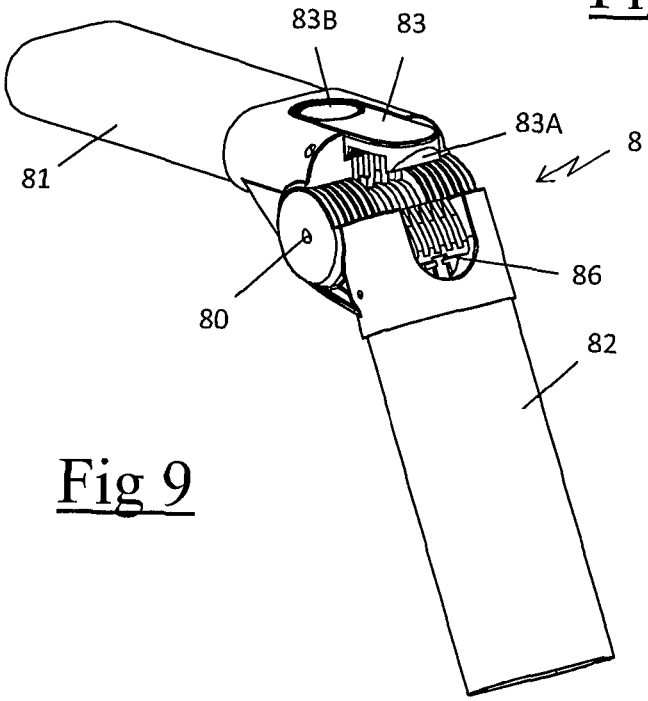
FIG. 9 is a perspective view of the joint of FIG. 8 in an intermediate folding phase.

Conversely, when the first unlocking button 83 is brought into the actuated position, the hook 83A is pivoted towards the outside of the joint 8 and disengages from the block stop 86 so that the second part 82 of the joint can pivot about the rotation axis 80, as illustrated in FIG. 9.

The second unlocking button 87 is linearly movable through an orifice 82A formed in the second part 82 of the joint and opening under the hook 83A of the first unlocking button 83, wherein the second unlocking button 87 can be moved between a rest position illustrated in FIG. 10, to which it is restored by a return spring 88, and an actuated position, into which it is brought when the user presses on the second unlocking button 87, as illustrated in FIG. 12.

According to FIG. 10, when the second unlocking button 87 is in the rest position, it occupies a retracted position in the orifice 82A that allows the hook 83A to engage behind the block stop 86. Conversely, when the second unlocking button 87 is in the actuated position, it occupies an extended position in which an end of the second unlocking button 87 pushes the hook 83A out of the orifice 83A, causing the hook 83A to disengage from the block stop 86 and allow the joint 8 to rotate freely.

The ironing board thus achieved has the advantage of being very ergonomic to use, as the folding of the legs of the ironing board into the storage position and the pivoting of the lower segment into the folded position can be performed in any order. In particular, the pivoting of the lower segment into the folded position can be accomplished with the board tilted on its second leg and with both legs still arranged in the working position, although this operation is also very easily performed with the two legs in the storage position and with the board standing upright on the second leg by pressing on the first or the second button, with less risk of pinching one's fingers.

This ironing board also has the advantage of great operational safety, as the board can be moved while in the working position without the risk of the lower segment accidentally pivoting into the folded position.

Furthermore, the pivoting of the lower segment into the folded position as illustrated in FIG. 6 makes it possible to obtain a highly compact ironing board in which the legs lie within the confines of the main part of the top and do not project beyond the top. Once it is in this storage position, the ironing board can be moved easily by tilting it slightly so that it rests only on the casters of the second leg.

The ironing board also has the advantage of having a top that provides a large ironing surface, and of being very stable once it is unfolded into the working position owing to a substantial base width between the first and second legs, which is due in particular to the substantial length of the first leg and to the presence of large cross members, which ensure excellent lateral stability of the ironing board.

The invention is obviously in no way limited to the embodiment described and illustrated herein, which was provided merely as an example. Modifications are still possible, specifically in terms of the construction of various elements or by substituting equivalent technologies without exceeding the scope of protection of the invention in any way.

Accordingly, in an alternative embodiment of the invention not shown, the top of the ironing board can be made in one piece and be fixed relative to the frame.

Accordingly, in an alternative embodiment of the invention not shown, the locking device can be omitted in the means for securing the lower segment in the unfolded position and said means can consist solely of spring-type return mechanisms, thus ensuring bistable equilibrium of the lower segment by returning it to either the unfolded position or the folded position, depending upon the angle of rotation of the joint.

The invention claimed is:

1. An ironing board comprising a frame supporting a top and at least two legs joined to said frame, one of the legs having an upper end pivotably mounted on a back end of the frame, the other leg having an upper end slidably mounted on the frame, the two legs being connected to one another by a pivot linkage at a midpoint of their length and being movable between a storage position, in which the legs are arranged essentially parallel to the top, and a working position, in which the legs are arranged in the shape of an X, wherein one of the legs, the so-called first leg, is divided into two parts joined to one another by a joint, said joint enabling, when the legs are in the storage position, the pivoting of a lower segment of the first leg from an unfolded position, in which said lower segment is disposed in the extension of an upper segment of the first leg, to a folded position, in which the lower segment is folded over the upper segment, characterized in wherein the other leg, the so-called second leg, is in one piece and in that the lower end of the second leg reaches the back end of the frame when the first and second legs are in the storage position.

2. The ironing board as in claim 1, wherein the joint has means for securing the lower segment in the unfolded position.

3. The ironing board as in claim 2, wherein the securing means comprise a device for locking the lower segment in the unfolded position and at least one unlocking button for deactivating the locking device.

4. The ironing board as in claim 3, wherein the joint has two unlocking buttons disposed on two opposite surfaces of the joint.

5. The ironing board as in claim 1, wherein the joint has a rotation axis which is offset to the periphery of the leg.

6. The ironing board as in claim 1, wherein the first leg has an upper end pivotably mounted on the back end of the frame.

7. The ironing board as in claim 1, wherein the top has a back end which is situated on the side of the frame receiving the upper end of the first leg and in that the top as a greater width in the vicinity of its back end than in the vicinity of its front end.

8. The ironing board as in claim 1, wherein the top has a main part slidably mounted on the frame and at least one foldable part joined to the main part by hinges, said foldable part being movable between a working position, in which the foldable part is disposed in the extension of the main part, and a storage position, in which the foldable part is folded over the main part.

9. The ironing board as in claim 8, wherein said foldable part is a back part of the top.

10. The ironing board as in claim 9, wherein said frame supports an iron rest which is linearly movable on the frame between a working position, in which the iron rest is disposed next to the foldable back part of the top in the working position, and a storage position, in which the foldable back part and the main part of the top are at least partly disposed under or on the iron rest.

11. The ironing board as in claim 1, wherein the top end of the second leg is mounted for linear movement along a guide track borne by the frame.

12. The ironing board as in claim 1, wherein the first leg and the second leg each have a lower end equipped with a cross member extending transversely to the top, said cross members having essentially the same width as the overall width of the top.

13. The ironing board as in claim 12, wherein the cross member of the second leg has casters.

14. The ironing board as claim 1, wherein said ironing board has a platform borne by a framework comprising a longitudinal end mounted pivotably about an axis borne by the upper segment of the first leg, between the pivot linkage and the joint.

* * * * *

UNITED STATES PATENT AND TRADEMARK OFFICE

CERTIFICATE OF CORRECTION

PATENT NO. : 8,776,411 B2
APPLICATION NO. : 13/900957
DATED : July 15, 2014
INVENTOR(S) : Ducruet et al.

It is certified that error appears in the above-identified patent and that said Letters Patent is hereby corrected as shown below:

In the Claims

Column 6, Line 53, Claim 1, after “segment,” delete “characterized in”

Column 7, Line 7, Claim 7, delete “as” and insert -- has --

Column 8, Line 16, Claim 14, after “as” insert -- in --

Signed and Sealed this
Eleventh Day of November, 2014

Michelle K. Lee

Michelle K. Lee
*Deputy Director of the United States Patent and Trademark Office*